United States Patent [19]

Fomby

[11] Patent Number: 4,711,365

[45] Date of Patent: Dec. 8, 1987

[54] CONTAINER AND CLOSURE ASSEMBLY WITH FOLDING SEALING RIBS

[76] Inventor: Kenneth A. Fomby, P.O. Box 636, Gainesville, Tex. 76240

[21] Appl. No.: 12,252

[22] Filed: Feb. 9, 1987

[51] Int. Cl.[4] ..... B65D 41/04

[52] U.S. Cl. ..... 220/288; 215/329; 215/344; 215/DIG. 1

[58] Field of Search ..... 220/288; 215/329, 344, 215/DIG. 1

[56] References Cited

U.S. PATENT DOCUMENTS

| | | | |
|---|---|---|---|
| 2,652,283 | 9/1953 | Roop . | |
| 2,741,402 | 4/1956 | Sayre . | |
| 3,125,237 | 3/1964 | Kitterman | 215/329 |
| 3,140,007 | 7/1964 | Nettleship . | |
| 3,881,627 | 5/1975 | Davolt | 215/329 |
| 3,935,968 | 2/1976 | Rausing | 215/356 |
| 4,089,463 | 5/1978 | Babiol | 215/329 |
| 4,090,631 | 5/1978 | Grussen | 215/DIG. 1 |

*Primary Examiner*—George T. Hall

*Attorney, Agent, or Firm*—Hubbard, Thurman, Turner & Tucker

[57] ABSTRACT

A container and closure assembly having a unique sealing surface to provide a reliable airtight seal. A generally cylindrical container having sidewalls and a base cooperably engages with a closure member by threading means. As the closure member is twisted to engage the threads of the container, an annular face of the container rim engages a complementarily configured annular recess in the closure member. Situated within the annular recess are disposed an array of interspaced, projecting rib members. As the flexible rib members are depressed against the annular face of the container rim, the ribs compress and fold over to create an effective airtight seal. A secondary seal is provided by an inner bevel forming part of the interior surface of the annular recess and a beveled surface of the annular rim of the container. The inner bevel facing and beveled surface of the container cooperably meet to form the additional airtight seal. The radial edge of the closure member forms a closure support collar which cooperates during sealing to engage a complementarily configured annular container support seat. Forces applied to the closure member are thereby transmitted to the sidewalls of the container, to permit a reliable seal during stacking or misuse.

20 Claims, 5 Drawing Figures

CONTAINER AND CLOSURE ASSEMBLY WITH FOLDING SEALING RIBS

BACKGROUND OF THE INVENTION

The present invention relates generally to leak proof containers and more particularly provides a unique container and closure assembly having folding, compressible sealing ribs.

The provision of adequate containers for the packaging and shipment of commercially available chemical products has evolved into a specialized industry. In fact, the desirability of one product over another in the marketplace and therefore its resulting commercial success is often directly related to packaging. With the advent of plastics technology and the development of injection molding techniques, the provision of specialized containers has waxed multifarious. One particular form of container widespread in demand is a re-usable, hermetically sealed container for holding chemical substances. For example, unstable chemical compounds such as plastic pipe glue, polymer caulking material and petroleum coating products having an alcohol or water base are easily subject to evaporation or hardening and are thereby rendered ineffective. This problem is exascerbated where repetitive and frequent access to the container is required for normal use of the product and the container lid becomes obstructed with material or is otherwise not carefully secured for an effective airtight seal.

Unfortunately, most available containers used for this purpose possess numerous shortcomings. A common theme has been to provide a container having a cap member which threadingly mates with the container. A resilient ring or gasket is placed between the rim of the container and the engaging surface of the lid to effect the airtight seal. However, with frequent use this gasket deteriorates or is inadvertently discarded. Alternative designs have incorporated the sealing gasket within the lid itself in the form of an annular ridge or lip which intersects with the rim of the container. While this design is somewhat effective, foreign material becoming embedded within the recessed area of the rim can interfere with a proper seal.

Another problem associated with container design is structural support. During shipment, containers are often stacked so as to result in a substantial amount of weight on the lower layers of containers. The trade has lacked in inexpensive design of plastic container with reinforced sidewalls, or other means such as a support collar incorporated within the lid to engage points of contact on the container itself which are not subject to torsional stress.

Currently available containers likewise fail to incorporate a secondary, smaller applicator aperture within the lid for frequent access to the contents of the container. The secondary lid is less likely to result in air or material leakage, due to it smaller size and easier cleaning maintenance. In applications in the equine or cattle industries, containers used for products such as hoof dressing, etc. are particularly well suited to a secondary aperture within the container lid for repeated access thereto.

It is accordingly an object of the present invention to provide a container and closure assembly which eliminates or substantially minimizes the above mentioned and other problems and limitations typically associated with leak proof containers of conventional design and construction.

SUMMARY OF THE INVENTION

The present invention provides a container and closure assembly having a unique sealing surface to provide a reliable airtight seal. The container is generally cylindrical in shape having sidewalls and a base. The closure member cooperably engages with an annular rim of the container by threading means. As the closure member is twisted to engage the threads of the container, an annular face of the container rim engages a complementarily configured annular recess in the closure member. Situated within the annular recess are disposed an array of interspaced, projecting rib members. The rib members are flexible and are formed contiguous with the closure member. As the ribs engage the annular face of the container, they compress and fold over to create an airtight seal. The folding of the ribs serves to effectively lock the closure member in place over the container, since increased torque is required to unfold the ribs to the upright position. It is contemplated that grip means in the form of scallops interspaced about the periphery of the upper portion of the closure member may also be provided to facilitate manual engagement and disengagement thereof. A secondary seal is provided by an inner bevel forming part of the interior surface of the annular recess and a beveled surface of the annular rim of the container. The inner bevel facing and beveled surface of the container meet to form an additional airtight seal.

In accordance with another aspect of the present invention, structural support means are provided to withstand forces applied to the container and closure assembly. Reinforcing supports are operably connected to the inner surface of the sidewalls of the container. The reinforced supports are interspaced radially about the sidewalls and prevent collapse of the container subject to inordinate compressive forces or misuse. In order to accommodate forces applied to the closure member such as during stacking for shipment, the radial edge of the annual recess of the closure member provides a closure support collar. The closure support collar is configured to cooperate with an annular container support seat of the container, wherein the closure support collar and container support seat meet during engagement of the container and closure member. Forces applied to the closure member are transmitted through the closure support collar and container support seat to the sidewalls of the container to prevent disruption of and damage to the sealing surfaces of the assembly.

The closure member of the present invention also contemplates the provision of an applicator aperture. Formed within the top portion of the closure member, the applicator aperture is of a reduced diameter and permits access to the container without removal of the closure member. The applicator aperture is particularly advantageous for applications where repeated and continuous access to the container is necessary during its use.

Compared to containers of conventional construction, the container and closure assembly of the present invention provides several distinct advantages. First, its simple construction renders it easy and relatively inexpensive to manufacture by injection molding techniques. The provision of projecting ribs which fold over and compress in response to engagement with the annular face of the container to effect the primary seal have resulted in improved sealing qualities. The folding ribs conform to the contours of the annular face to permit an effective seal even during adverse conditions such as where foreign material is deposited on the annular face. Likewise, the folding ribs upon full engagement provide a unique "lock" such that an increased amount of torque is required to unfold the ribs and disengage the closure member once the seal has been effected. The multiple sealing surfaces provided in combination with the structural support surfaces and reinforced sidewalls result in a rugged, reusable leakproof container.

DETAILED DESCRIPTION

Figure 1:
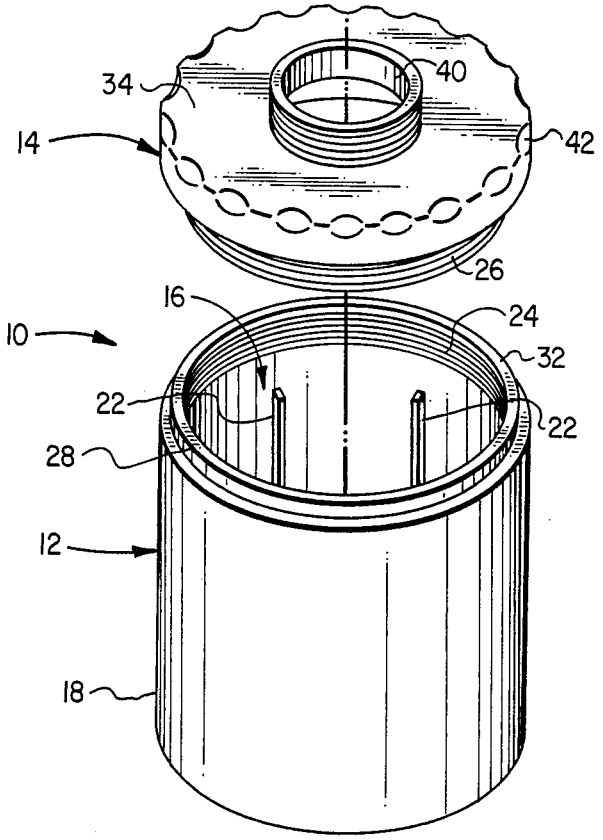
FIG. 1 is an exploded, perspective view of a reinforced container and closure assembly which embodies principals of the present invention.

Perspectively illustrated in FIG. 1 is a container and closure assembly which embodies principals of the present invention and is utilized for effective packaging and storage of chemicals and a wide variety of commercially available products. The assembly 10 is particularly well adapted to be reusable and is uniquely constructed to efficiently provide an effective airtight seal between container 12 and closure member 14.

Figure 2:
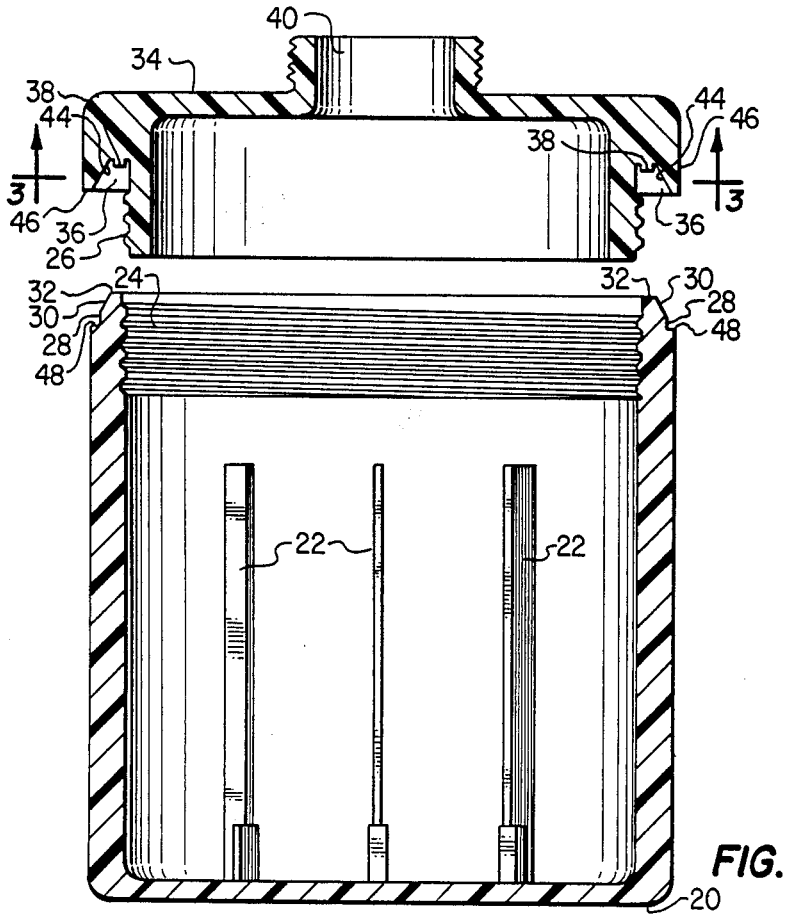
FIG. 2 is an enlarged, elevated side view of the reinforced container and closure assembly showing the closure elevated above the container.
Figure 3:
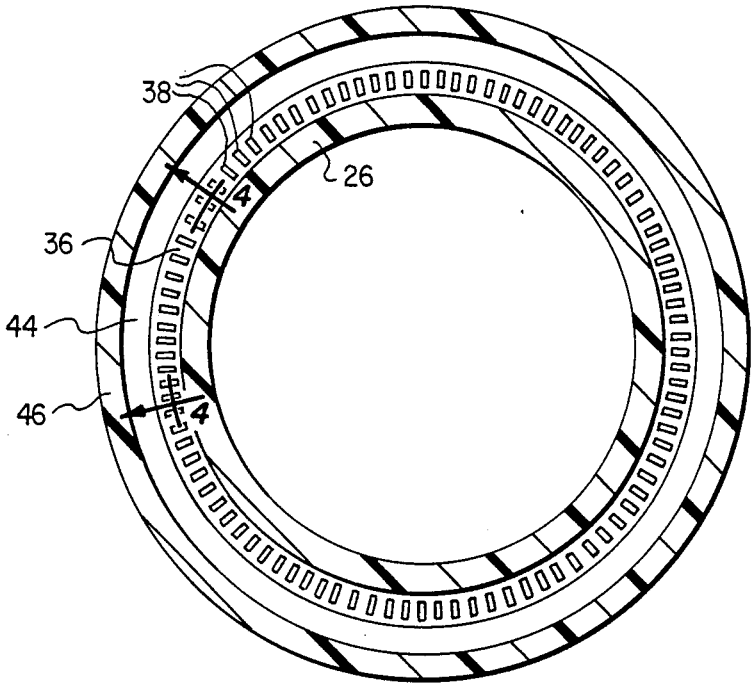
FIG. 3 is a cross-sectional view through the closure taken along line 3—3 of FIG. 2, and illustrates the configuration of the sealing ribs within the recessed rim engaging area of the closure.

Referring now to FIGS. 1-2, the assembly 10 comprises a hollow, plastic container 12 and a complementarily configured closure member 14 for covering open end 16 of container 12 and providing an effective airtight seal therebetween. In the preferred embodiment, container 12 is constructed of injection molded plastic material and is generally cylindrical in shape. Of course, a variety of shapes and sizes for container 12 may be contemplated depending upon the desired application. Container 12 is generally defined by sidewalls 18 and base 20. Operably connected to the inner surface of sidewalls 28 are a plurality of interspaced reinforcing supports 22. Reinforcing supports 22 are formed contiguous with sidewalls 18 and a portion of base 20 and provide additional strength to container 12. Reinforcing supports 22 prevent sidewalls 18 from becoming deformed due to mishandling and also provide vertical support to absorb stacking forces, minimizing disruption of the sealing surfaces subsequently described. Operative engagement of container 12 and closure member 14 is accomplished by threads 24 situated along the inner surface of sidewalls 18 which meet with complementarily configured threads 26 of closure member 14. Placement of threads 24 on the inner surface of sidewalls 18 in the preferred embodiment optimizes the strength of sidewalls 18, and enhances the general appearance of assembly 10 and the operation of the sealing and support means of the present invention. Sidewalls 18 of container 12 terminate at open end 16 to form annular rim 28. Annular rim 28 includes a beveled surface 30 and terminates in annular face 32. As will be subsequently described, annular face 32 and beveled surface 30 operatively engage closure member 14 to form the primary and secondary sealing surfaces, respectively, of the present invention.

The closure member 14 is complementarily configured to engage container 12 at threads 26, and is also preferably constructed of durable, injection molded plastic. Closure member 14 includes a top portion 34 and has extending generally downwardly therefrom radially outwardly facing threads 26. A unique annular recess 36 is formed radially adjacent to threads 26 and extends generally downwardly from closure member 14 for the purpose of engaging and housing the annular rim 28 of container 12. Situated within annular recess 36 is an array of interspaced projecting ribs, which will be described in greater detail with reference to the primary seal of apparatus 10. Closure member 14 further includes, in the preferred embodiment, an applicator aperture 40 extending through top portion 34. Numerous uses for the assembly 10 require continuous and repetitive access to the interior contents of the container 12. Applicator aperture 40 permits access to container 12 without the need to break the airtight seal formed betwen closure member 14 and container 12. An applicator cap (not shown) may be placed over applicator aperture 40 for seal thereof, and may include accoutrements such as an applicator brush. In order to facilitate manual twisting of closure member 14, the radial periphery of top portion 34 includes a plurality of interspaced scallops 42. Scallops 42 form indentations particularly well suited for finger gripping and prevent slippage during application of torque to closure member 14.

Figure 4:
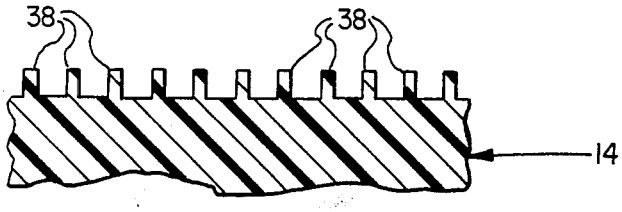
FIG. 4 is an enlarged, cutaway, side view taken along line 4—4 of FIG. 3 and depicts an exagerated view of the sealing ribs in their extended position prior to engagement with the rim of the container.
Figure 5:
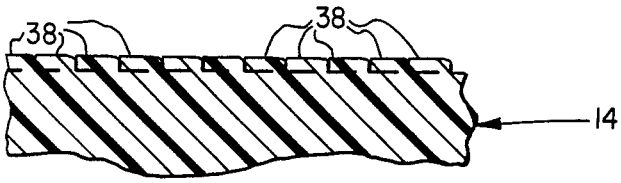
FIG. 5 is a cutaway, side view taken along line 4—4 of FIG. 3 showing the sealing ribs in their folded and compressed position during engagement of the closure with the container rim to effect an airtight seal.

Referring to FIGS. 2-5, the primary and secondary sealing means of the assembly 10 form an airtight seal between container 12 and closure member 14. As the annular rim 28 of container 12 engages the annular recess 36 of closure member 14 by the mating of threads 24 and 26, annular face 32 engages projecting ribs 38. The primary airtight seal of assembly 10 is thereby created as annular face 32 presses against projecting ribs 38 compressing them and folding them over as depicted in FIGS. 4 and 5. Ribs 38 are flexible and project generally downwardly prior to engagement with annular face 32, and are sufficiently resilient to return to their projected position upon disengagement of threads 24 and 26. As the ribs 38 overlie and conform to the space provided between the annular recess 36 and annular face 32, an airtight seal is effectuated. Ribs 38 are particularly effective under adverse conditions such as where annular face 32 has an uneven or irregular surface as a result of may contain foreign material being deposited thereon. Ribs 38 fold and deform accordingly, and in the sealed position leave no room for leakage. It has likewise been observed that the engagement of ribs 38 with annular face 32 result in an effective "lock" of closure member 14 to container 12. After ribs 38 have been folded over into the sealed position, it requires a greater twisting force to disengage closure member 14 and return ribs 38 to the upright, projected position. Scallops 42 are particularly useful at this point to facilitate manual twisting of closure member 14.

A secondary sealing surface is provided between container 12 and closure member 14 operable simultaneously with the primary seal described above. The outer wall of annular recess 36 forms an annular inner bevel 40 which is complementarily configured to engage beveled surface 30 of container 12. During engagement of threads 24 and 26 and the primary seal by the folding and compression of ribs 38 against annular face 32, beveled surface 30 and inner bevel 44 cooperably engage to form a seal therebetween. In addition to providing an airtight seal, beveled surface 30 and inner bevel 44 serve to provide a protective barrier by isolating the primary seal from outside forces, foreign material and the elements.

The outer portion of inner bevel 44 at the outer radially edge of closure member 14 additionally serves to form an annular closure support collar 46. Upon full engagement of the primary and secondary seals of assembly 10, support collar 46 cooperably engages container support seat 48. Container support seat 48 comprises a recessed area along annular rim 28 for complementary engagement with the support collar 46. Forces applied to closure member 14 are thereby effectively transmitted through support collar 46 and support seat 48 to sidewalls 18. Compressive forces resulting from stacking or misuse are thereby directed away from the sealing areas to provide a rugged, reliable assembly 10.

It can be appreciated from the foregoing that container and closure assembly 10 of the present invention provides an effective airtight seal which is of a simple, reliable and relatively inexpensive construction and readily adaptable to a wide variety of applications. Due to the unique cooperation between the injection molded components to create a primary and secondary sealing area and the provision of a support means for directing forces away from the sealing surfaces, a reliable and rugged airtight container assembly is provided. Problems associated with conventional containers are eliminated, as for example wherein foreign material becomes deposited along the rim of the container in a manner to render ineffective the sealing components. The flexible, compressible folding ribs of the present invention provide a reliable and versatile seal previously unknown to the industry.

The foregoing detailed description is to be clearly understood as being given by way of illustration and example only, the spirit and scope of the present invention being limited solely by the appended claims.

What is claimed is:

1. A container and closure assembly, comprising:
a container having an open end portion;
a closure member adapted to engage and cover said open end portion; and
cooperative means on said container and said closure member for creating a seal therebetween; said cooperative means including a spaced plurality of flexible rib members associated with one of said container and closure member and a portion of the other of said container and said closure member adapted to engage and deform said spaced plurality of rib members.

2. The assembly according to claim 1 wherein:
said portion of the other of said container and said closure member is adapted to engage and fold over said spaced plurality of rib members.

3. The apparatus according to claim 1 wherein:
one of said container and said closure member has formed therein a recess, said flexible rib members being positioned within said recess, and wherein said portion is adapted to be received within said recess.

4, The apparatus according to claim 1 wherein:
said container and said closure member include complementarily configured annular bevels for providing an additional sealing surface.

5. The apparatus according to claim 1 wherein:
said container and said closure member include support means for transmitting forces applied to said closure member to said container, said support means including an annular closure face complementarily configured to engage an annular container sidewall face.

6. The apparatus according to claim 1 wherein:
said container and said closure member include cooperable threading means for selectively engaging and disengaging said cooperative means of said container and said closure member.

7. The apparatus according to claim 6 wherein:
said cooperable threading means includes threads on the inner surface of said container which operably engage radially outwardly facing threads on said closure member.

8. The apparatus according to claim 6 wherein:
said closure member includes gripping means for facilitating manual twisting thereof, said gripping means including an array of interspaced scallops along the radial perimeter of said closure member.

9. The apparatus according to claim 1 wherein:
said closure member includes an applicator aperture for access to said container.

10. The apparatus according to claim 1 wherein:
said container includes reinforcing supports operably connected to sidewalls of said container.

11. A container and closure assembly, comprising:
a container having sidewalls and an open end;
a closure member engageable with said open end;
cooperative sealing means on said container and said closure member for creating a seal therebetween; said cooperative sealing means including an annular array of interspaced flexible ribs operably connected to said closure member and an annular rim terminating in an annular face at said open end wherein said annular face and said annular array complementarily engage and deform said flexible ribs to create said seal.

12. The apparatus according to claim 11 wherein:
said flexible ribs fold to create said seal.

13. The apparatus according to claim 11 wherein:
said array is situated within an annular recess complementarily configured to engage said annular rim.

14. The apparatus according to claim 13 wherein:
said annular rim and said annular recess include cooperable annular bevels which engage to provide an additional sealing surface.

15. The apparatus according to claim 11 wherein:
said closure member and said container include cooperable threading means for engagement thereof.

16. The apparatus according to claim 15 wherein:
said closure member includes gripping means for manual twisting of said closure member, said gripping means including scallops interspaced along the periphery of said closure member.

17. The apparatus according to claim 11 wherein:
said closure member includes an applicator aperture for access to said container.

18. The apparatus according to claim 11 wherein:

said container includes reinforcing supports operably connected to said sidewalls.

19. The apparatus according to claim 11 wherein:

said container and said closure member include operably engaging support faces for transmitting force applied to said closure member to said sidewalls of said container.

20. A container and closure assembly, comprising:

a container having a base, sidewalls, and an open end, said sidewalls having reinforcing supports operably connected thereto;

a closure member engageable with said container having an applicator aperture therein substantially smaller in diameter than said open end;

cooperative sealing means on said container and said closure member for creating a seal therebetween, said cooperative sealing means including an annular array of interspaced flexible ribs situated within an annular recess of said closure member, and a complementarily configured annular rim terminating in an annular face at said open end of said container wherein said annular face engages and folds said ribs to create said seal;

secondary cooperative sealing means on said container and said closure member for creating a seal therebetween; said secondary sealing means including complementarily configured annular bevels forming a portion of said annular recess and said annular rim;

support means for transmitting force from said closure member to said sidewalls, said support means including complementarily configured annular support faces forming a portion of said closure member and said container;

thread means for engaging said closure member and said container; said thread means including threads formed on the interior surface of said sidewalls complementarily configured to engage radially outwardly forcing threads forming a portion of said closure member.

* * * * *